US009573287B2

(12) United States Patent
Asai

(10) Patent No.: US 9,573,287 B2
(45) Date of Patent: Feb. 21, 2017

(54) METHOD FOR PRODUCING BALANCE CORRECTION SHEET FOR PUNCHING MACHINE

(71) Applicant: MAKE A BOX CO., LTD., Ishikawa (JP)

(72) Inventor: Kazuaki Asai, Kanazawa (JP)

(73) Assignee: MAKE A BOX CO., LTD., Kanazawa-shi, Ishikawa (JP)

( * ) Notice: Subject to any disclaimer, the term of this patent is extended or adjusted under 35 U.S.C. 154(b) by 432 days.

(21) Appl. No.: 14/124,128

(22) PCT Filed: Feb. 5, 2013

(86) PCT No.: PCT/JP2013/052532
§ 371 (c)(1),
(2) Date: Dec. 5, 2013

(87) PCT Pub. No.: WO2013/118692
PCT Pub. Date: Aug. 15, 2013

(65) Prior Publication Data

US 2014/0130323 A1 May 15, 2014

(30) Foreign Application Priority Data

Feb. 11, 2012 (JP) ..... 2012-027867
Jun. 4, 2012 (JP) ..... 2012-126901

(51) Int. Cl.
*B26D 7/26* (2006.01)
*B26F 1/14* (2006.01)
(Continued)

(52) U.S. Cl.
CPC . *B26F 1/14* (2013.01); *B26D 7/26* (2013.01); *B26F 1/44* (2013.01); *B31B 1/14* (2013.01);
(Continued)

(58) Field of Classification Search
CPC ..... B26D 7/26; B26F 1/44; B26F 1/14; Y10T 83/02
See application file for complete search history.

(56) References Cited

U.S. PATENT DOCUMENTS 4,823,660 A * 4/1989 Forthmann ..... B26D 7/10 83/123
5,104,370 A 4/1992 Yerly et al.
(Continued)

FOREIGN PATENT DOCUMENTS

JP S55-17766 U 2/1980
JP 2004-202617 A 7/2004
(Continued)

*Primary Examiner* — Sean Michalski
*Assistant Examiner* — Liang Dong
(74) *Attorney, Agent, or Firm* — Manabu Kanesaka

(57) ABSTRACT

A balance correction sheet corrects a whole pressure balance of a punching machine, in which a punching die and a cutting plate for receiving blade tips of the punching die are attached to be opposed to each other. A method of forming the balance correction sheets includes attaching a balance correction die having a plurality of punching blades disposed at a predetermined interval to the punching machine, intermediately inserting the blade tips of the punching blades into a middle of laminated sheets formed by laminating peelable sheets so that incisions are formed in a depth direction of the laminated sheets, and partially removing the laminated sheets depending on depths of the incisions so as to prepare the balance correction sheet.

6 Claims, 16 Drawing Sheets

(51) Int. Cl.
*B31B 1/14* (2006.01)
*B26F 1/44* (2006.01)

(52) U.S. Cl.
CPC *B26F 2001/4409* (2013.01); *B26F 2001/4418* (2013.01); *B31B 2201/252* (2013.01); *B31B 2203/084* (2013.01); *B31B 2203/101* (2013.01); *Y10T 29/49718* (2015.01); *Y10T 83/02* (2015.04); *Y10T 428/15* (2015.01)

(56) References Cited

U.S. PATENT DOCUMENTS 5,488,889 A * 2/1996 Kang ..... B26D 3/085
83/346
2006/0233995 A1 * 10/2006 Garland ..... B31D 1/021
428/41.8

FOREIGN PATENT DOCUMENTS

JP 2005-023280 A 1/2005
JP 2010-029956 A 2/2010

* cited by examiner

METHOD FOR PRODUCING BALANCE CORRECTION SHEET FOR PUNCHING MACHINE

RELATED APPLICATIONS

The present application is National Phase of International Application No. PCT/JP2013/052532 filed Feb. 5, 2013, and claims priority from Japanese Applications No. 2012-027867, filed Feb. 11, 2012 and No. 2012-126901, filed Jun. 4, 2012.

TECHNICAL FIELD

The present invention relates to a method for producing balance correction sheet for punching machine, which punches paper so as to form an outer shape(s) of a paper vessel(s), cardboard, etc.

BACKGROUND ART

Paper vessels, cardboards, etc. also referred to as packaging containers or paper boxes are formed by punching, bending, and mutually pasting the paper which is comprised of, for example, a plurality of paper types or complex materials of paper types and resins or metals other than paper, cardboards, and coating paper. The paper vessels are lightweight, are useful for transportation, and are widely used in many industrial fields such as food industries, electronic parts industries, and automobile related industries.

FIG. 30 is a cross-sectional view schematically showing the relations between a punching die, paper, and a cutting plate in a known punching machine. A punching die 220 is used for punching of paper 100. The punching die 220 is manufactured by: subjecting a veneer board to laser processing along the outer shape, which is to form a paper vessel, and ruled lines for bending; forming penetrating grooves for punching blades 260 corresponding to the outer shape, which is to form the paper vessel, and penetrating grooves for ruled-line depressing members 250; and embedding the punching blades 260 and the ruled-line depressing members 250 in the respective penetrating grooves. The height dimensions of the ruled-line depressing members 250 are set to be smaller than those of the punching blades 260, and the downward projecting distances of the ruled-line depressing members 250 are the projecting distances smaller than those of the punching blades 260. When the paper 100 is to be punched by an outer-shape line as symbol 101 for forming the paper vessel and scores 102 are to be formed thereon, the scores 102 are formed, and the paper is cut at the same time while holding the paper 100 by rubber members 265 disposed on the punching die 220 so that the paper is not moved. A facing plate 270 is also referred to as a counter plate, is made of plastic such as ABS, PBT, PPS, or a Phenol resin, is comprised of a plate-like, a sheet-like, or a film-like substrate, and is manufactured by processing grooves 271 by cutting at the positions corresponding to the ruled-line depressing members 250 of the punching die 220 by an NC processing machine according to CAD data for manufacturing the punching die 220 and removing the substrate so that the parts which are to abut the punching blades 260 serve as outer peripheries.

In FIG. 30, the punching die 220 is attached to an upper surface plate 191 side of the punching machine. The facing plate 270 is pasted onto a cutting plate 240 and receives the paper 100. Then, the cutting plate 240 is attached to a lower surface plate 192 side of the punching machine, for example, by being mounted on an unshown chase like as frame and receives blade tips of the punching blades 260 disposed on the punching die 220. Then, the paper 100 is inserted between the blade tips of the punching die 220 attached to the upper surface plate 191 of the punching machine and the facing plate 270 on the cutting plate 240 attached to the lower surface plate 192 of the punching machine, and punching is carried out by moving up the lower surface plate 192 and then moving down the lower surface plate 192 (see FIG. 30). More specifically, the paper 100 is cut into a predetermined shape as the locations of the symbols 101 by the punching blades 260, the plurality of scores 102 are engraved on required parts by the ruled-line depressing members 250 and the groove parts 271 of the facing plate 270, thereby forming a blank of punched paper 100. Then, a paper vessel is assembled by valley-folding the blank of punched paper 100 along the scores 102 and mutually pasting bonding margins thereof. Other than that, in addition to the above description, there is a configuration of punching the paper 100, in which perforations which are to serve as a zipper are formed, and forming scores and perforations by incising blades provided on the punching die 220 although not shown in the drawing. FIG. 30 employs a disposition configuration in which the punching die 220 is in the upper side and the cutting plate 240 is in the lower side; however, there is also a case employing a disposition configuration in which the cutting plate 240 is in the upper side and the punching die 220 is in the lower side.

In the above described punching, one blank of punched paper 100 is sometimes formed by one operation. However, in order to enhance productivity, it is preferred to form a plurality of blanks of punched paper 100 at the same time. For example, FIG. 32 exemplifies a known punching die 220 in a state in which the blade tips of punching blades 260 are in the front side, and FIG. 33 exemplifies a known cutting plate 240 in a state in which facing plates 270 are in the front side. In the configuration examples shown in FIG. 32 and FIG. 33, four blanks of punched paper 100 are formed at the same time by one operation.

In order to evenly punch the above described blank, particularly, each of the above described plurality of blanks, the pressing force of the punching die has to be set so that the pressing force is evenly applied to the paper. However, problems in terms of maintenance, time-course changes, etc. are causes that generate unevenness in the pressing force of the punching die. Therefore, in order to evenly punch each of the above described blanks, various efforts for decreasing the pressing-force unevenness of the punching die have been made.

Conventionally, it is known that unevenness is generated in the pressing force due to variations in the lengths of a plurality of punching blades or ruled-line members disposed on a punching die, and a below method is known as a method of removing the unevenness in this case. FIG. 30 is a cross-sectional view schematically showing the relations of unevenness removing paper, the punching die, the paper, and the cutting plate. FIG. 31 is a perspective view showing known unevenness removing paper from an oblique lower side. In the configuration example shown in FIG. 30, the cutting plate 240 is disposed on an upper surface 192*a* of the lower surface plate 192 of the punching machine, a backing metal plate 221 is disposed between the back side (the upper side in FIG. 30) of the punching die 220 and the upper surface plate 191 of the punching machine, and the unevenness removing paper 230 is disposed between the back side (the upper side in FIG. 30) of the backing metal plate 221 and a lower surface 191*a* of the upper surface plate 191 of the punching machine. The above described unevenness removing paper 230 increases the pressing force of the punching blades 260 and the ruled-line members 250 by locally pasting and laminating commercially-available adhesive tapes 239 on one sheet of thin paper 238 comprised of, for example, paper or resin on which the drawing shape of the punching die 220 is drawn and increasing the volume thereof, thereby removing the unevenness (see FIG. 31). Then, dummy paper is set and subjected to trial punching, or the actual paper 100 is subjected to trial punching; and an unevenness removing operation of the punching die is carried out by pasting the commercially-available adhesive tapes 239 onto corresponding parts while observing the appearance of the punched paper or dents formed on the unevenness removing paper 230 caused by collision with the punching blades 260 and the bottom surfaces of the ruled-line members 250.

PRIOR ART DOCUMENT

Patent Document

Patent Document 1 describes that the pressing force of the punching blades is increased by placing the unevenness removing paper on the back side (the upper side in a drawing described in Patent Document 1) of the punching die and pasting adhesive tapes on the unevenness removing paper, perforations or incisions are formed at a predetermined interval on the narrow belt-like adhesive tapes, and the unevenness removing adhesive tapes can be cut out by a predetermined length.

Patent Document 2 describes that, in a configuration in which the punching die is mounted on a chase like a frame, a metal plate for removing unevenness, the unevenness removing paper, and a volume-increasing board are sequentially disposed in the back side (the lower side in a drawing described in Patent Document 2) of the punching die, and the punching die, the metal plate for removing unevenness, the unevenness removing paper, and the volume-increasing board are disposed so that they can be mutually joined/separated, thereby facilitating attachment/detachment of the unevenness removing paper. Moreover, Patent Document 2 describes that an unevenness removing operation is carried out by pasting tapes onto predetermined locations while observing dents, which have been caused by collisions with punching blades or bottom surfaces of ruled-line members and formed on the unevenness removing paper, which serves as an underlay of the metal plate.

Patent Document 3 describes that, in order to decrease the unevenness in the pressing force by increasing/decreasing the pressing force of the plurality of disposed punching blades or ruled-line members with respect to generation of the unevenness in the pressing force caused by variations in the lengths of the plurality of punching blades or ruled-line members disposed on the punching die in the above described manner, the unevenness removing paper, a transparent laminated sheet, and a planar pressure sensor are sequentially disposed on the back side (the upper side in a drawing described in Patent Document 3) of the punching die, the pressure distribution of the pressing force applied upon punching of the paper is measured by the planar pressure sensor, and, in view of the measurement result of the pressure distribution, the pressing force of the punching blades or the ruled-line members is decreased by locally peeling off the transparent laminated sheet, or the pressing force of the punching blades or the ruled-line members is increased by locally pasting thin pieces onto the transparent laminated sheet. In Patent Document 3, the material and configuration of the transparent laminated sheet and the method of local peel-off are not described, and it mainly focuses on measurement and evaluation of the pressure distribution by the planar pressure sensor.

Thus, in the prior art described in Patent Documents 1 and 2, generation of the unevenness in the pressing force caused by the variations in the lengths of the plurality of punching blades or the ruled-line members disposed on the punching die is a problem, and a means of solution to the problem is to carry out an unevenness removing operation by increasing the pressing force of the punching blades or the ruled-line members by disposing, as unevenness removing paper, one sheet of thin paper, which is comprised of paper, a resin, or the like on which the drawing shape of a punching die is drawn, on the back side of the punching die and locally pasting and laminating the adhesive tapes to increase the volume thereof. In the conventional technique described in Patent Document 3, the point that the unevenness removing paper, the transparent laminated sheet, and the planar pressure sensor are sequentially disposed is different from Patent Documents 1 and 2; however, a problem to be solved is a problem that unevenness is generated in the pressing force due to variations in the plurality of punching blades or ruled-line members disposed on the punching die as well as Patent Documents 1 and 2, and the idea thereof is to decrease the unevenness in the pressing force based on the evaluation of the pressure distribution by the planar pressure sensor.

Patent Document 1 is JP2005-023280A1
Patent Document 2 is JP2010-029956A1
Patent Document 3 is JP2004-202617A1

BRIEF SUMMARY OF THE INVENTION

Problems the Invention Intends to Solve

However, the problems of all of the prior art described in Patent Documents 1 to 3 are the generation of unevenness in the pressing force due to variations in the lengths of the plurality of punching blades or ruled-line members disposed on the punching die, and the techniques have not reached the idea of correcting the balance of the pressing force of the punching machine per se. Therefore, an unevenness removing operation has to be carried out from the beginning every time the punching die is replaced, and the unevenness removing operation has been cumbersome.

Therefore, the inventor of the present application carried out research and found out that usage of the punching machine is started in a state in which the pressing force as punching pressure thereof is balanced as a whole when the punching machine is new; however, along with usage over a long period, cumulative increase in the punching volume, etc., for example a drive part or a drive coupling part of the punching machine is distorted or worn, the pressure balance of the whole punching machine is lost, and weak-punching-pressure locations and strong-punching-pressure locations are generated. Against the lost pressure balance of the whole punching machine, there is a measure of overhauling the punching machine; however, in production sites, it is often difficult to stop facilities for a long period of time, and it is also difficult to judge whether the pressure balance of the whole punching machine has been lost or not; therefore, the punching machine is operated in the unchanged state in practice. Therefore, in a situation in which the pressure balance of the whole punching machine is lost, an unevenness removing operation has been required to be carried out in a state in which both of the inequality of the pressure balance of the whole punching machine and unevenness of the punching die are overlapped in the unevenness removing operation of the above described punching dies, and the operation has been extremely cumbersome.

In view of the above, the present invention to provide a method for producing balance correction sheet for punching machine, a balance correction die for punching machine, a method of balance correction for punching machine, and the balance correction sheet for punching machine capable of decreasing punching unevenness of a paper vessel in advance by correcting whole pressure balance in a stage before attachment of a punching die with respect to the punching machine in which the whole pressing-force balance has been lost due to distortion or wear of a drive part or a drive coupling part thereof, and weak-punching-pressure locations and strong-punching-pressure locations have been generated.

Means for Solving the Problems

In order to equalize the pressure balance for punching machine, a method of balance correction for punching machine use of the balance correction sheet according to invention, wherein the balance correction sheet is disposed at a position in the back-side direction of the cutting plate of the punching machine or is disposed at a position in a back-side direction of a punching die of the punching machine.

The balance correction sheet is comprised of a laminated sheet in which peelable sheets are laminated. The balance correction sheet is disposed, for example, at the position in the back-side direction of the cutting plate of the punching machine. More specifically, at the position between the cutting plate and a surface plate of the cutting plate side as the surface plate in a side facing blade tips of the punching die, the sheet is disposed in the direction that a lowermost layer of the sheet is in the surface plate side of the cutting plate side. The balance correction sheet is disposed, for example, at the position in the back-side direction of the punching die of the punching machine. More specifically, at the position between the punching die and a surface plate in the punching die side as the surface plate in the side facing the cutting plate, the sheet is disposed in the direction that the lowermost layer of the sheet is in the surface plate side of the punching die side.

According to the present invention, the balance correction sheet is disposed at the position in the back-side direction of the cutting plate of the punching machine or at the position in the back-side direction of the punching die of the punching machine, thereby providing a function of increasing the pressure of a location where a punching pressure is weak in the punching machine and decreasing the pressure at a location where the punching pressure is strong. By virtue of this function, the whole pressure balance can be corrected in a stage before attachment of the punching die, and punching unevenness of a paper vessel can be decreased in advance. The method of preparing the balance correction sheet and the balance correction die of the punching machine will be described later.

A balance correction sheet for punching machine produced by a method according to invention, wherein the balance correction sheet incisions are formed in a laminated sheet in which peelable sheets are laminated, and the balance correction sheet is partially removed depending on the depths of the incisions.

The balance correction sheet for punching machine made by a balance correction die according to the invention, wherein the balance correction sheet incisions are formed in a laminated sheet in which peelable sheets are laminated, and the balance correction sheet is partially removed depending on the depths of the incisions. The balance correction sheet is comprised of the laminated sheet in which the peelable sheets are laminated, the incisions are configured to be shallowly formed at the location where the punching pressure is weak in the punching machine, the incisions are configured to be deeply formed at the location where the punching pressure is strong, and the balance correction sheet is partially removed depending on the depths of the incisions. More specifically, regarding the thickness of the balance correction sheet, the thickness is large at the location where the punching pressure is weak in the punching machine, and the thickness is small at the location where the punching pressure is strong. This configuration functions to increase the pressure at the location where the punching pressure is weak in the punching machine and decrease the pressure at the location where the punching pressure is strong.

According to the present invention, the balance correction sheet is attached to the punching machine in advance; as a result, a state in which the pressure balance of the whole punching machine is equalized is obtained. By virtue of this, an unevenness removing operation upon replacement of the punching die becomes easy.

The balance correction sheet is comprised of a laminated sheet in which peelable sheets are laminated. The materials of the sheets are comprised of, for example, paper, resins, metals, and complex materials thereof, and the sheets are peelably laminated. More specifically, various thin plates of, for example, paper, polyphenylene sulfide (PPS), polypropylene (PP), polyethylene, polystyrene, polyvinyl chloride, polyethylene terephthalate (PET), polyimide, acetate, acrylic, epoxy, aluminum, iron, stainless steel, etc., and complex materials thereof can be applied to the sheets.

Examples of the sheets provided with the peelable function include an adhesive-agent-equipped sheet in which an adhesive layer formed by an adhesive agent is formed on at least one surface thereof. A known adhesive agent which is, for example, rubber based or acrylic is applied as the adhesive agent. For example, a sheet comprised of a material provided with an adsorbing characteristic because of, for example, the surface shape thereof or a sheet comprised of a material which carries out attraction by static electricity may be used.

The thickness of the sheet is preferred to be 2 micrometer or more and 1000 micrometer or less. This is for reasons that, if the thickness of each one of the sheets is less than 2 micrometer, a peeling operation becomes difficult, and that, if the thickness of each sheet exceeds 1000 micrometer, it becomes difficult to obtain the precision required for the balance correction. As a more preferred mode, the thickness of the sheet is set to 10 micrometer or more and 100 micrometer or less.

The number of the laminated layers of the sheets is preferred to be 3 or more and 100 or less. This is for reasons that, if the number of the laminated layers of the sheets is less than 3, it becomes difficult to obtain the precision required for the balance correction, and that, if the number of the laminated layers exceeds 100, it becomes difficult to maintain the laminated-layer shape in a certain shape. As a more preferred mode, the number of the laminated layers of the sheets is set to 5 or more and 25 or less.

The balance correction sheets according to the present invention are characterized in that any one or more species of identifiers including colors, contrasting densities, patterns, line segments, numbers, characters, and signs is identifiably imparted to at least each of the incisions, so that the sheets are laminated to have the identifiers which are mutually different corresponding to the laminated positions thereof.

According to the present invention, the sheets are laminated so that the identifiers are mutually different to correspond to the laminated positions thereof; therefore, it is easy to identify in which layer of the laminated sheet the incised and peeled-off sheet is. In the sheets having mutually different identifies, the identifiers may be different at every certain cycle of a predetermined laminated sheet thickness, or the identifiers may be different at every laminated position. Particularly, since the sheets are color sheets, in which layer of the laminated sheet the incised and peeled-off sheet is present becomes apparent, which is particularly preferred.

The balance correction sheet of the punching machine according to the present invention wherein the sheets are made of plastic, and the sheet incisions are not formed at least in the lowermost layer of the laminated sheet. According to the present invention, cut powder is not easily generated compared with paper-made sheets and metal-made sheets, the sheets are easily peelable compared with metal-made sheets, and the sheets are excellent in dimensional stability compared with paper made sheets.

The balance correction sheet for punching machine according to the present invention wherein the sheets are made of plastic, and the sheet incisions are not formed at least in the lowermost layer of the laminated sheet. According to the present invention, handling of the balance correction sheet becomes easy, and there is no risk that the blade tips of the balance correction die for punching machine may abut the cutting plate on which the laminated sheet is placed.

For example, in the lowermost layer of the laminated sheet, paper of a harder material or a larger thickness compared with the sheets in upper layers may be configured to be disposed. When such a configuration is employed, the balance correction sheet is not easily deformed, and handling thereof becomes easy.

The method of balance correction for punching machine use of the balance correction sheet according to present invention, wherein the balance correction sheet is attached a housing pocket on a back-side surface of the cutting plate in advance and attachably/detachably housing the balance correction sheet in the housing pocket, and the balance correction sheet is disposed at a position in the back-side direction of the cutting plate of the punching machine.

Examples of a method of attaching the balance correction sheet include a method of attaching a housing pocket on a back-side surface of the cutting plate in advance and attachably/detachably housing the balance correction sheet in the housing pocket. According to this method, upon replacement of the cutting plate, which is a consumable member, it is easy to take out the balance correction sheet from the housing pocket and attaching it to a new cutting plate. Examples of the method of attaching the balance correction sheet may also include a method of causing an attachment surface of the balance correction sheet to be an adhesive surface in advance and pasting the adhesive surface onto the back-side surface of the cutting plate.

According to the present invention, a method for producing balance correction sheet used upon punching of paper so as to form an outer shape of a paper vessel, the balance correction sheet used for correcting the whole pressure balance of a punching machine, in which a punching die and a cutting plate for receiving blade tips of the punching die are attached to be opposed to each other, the method comprising steps of: attaching a balance correction die to the punching machine, the balance correction die having a plurality of punching blades disposed at a predetermined interval; intermediately inserting the blade tips of the punching blades into a middle of a laminated sheet formed by laminating peelable sheets, cuts are formed in the depth direction of the laminated sheet; and then partially removing the laminated sheet depending on the depths of the incisions so as to prepare the balance correction sheet.

In the present invention, the balance correction die of the punching machine having the plurality of punching blades disposed at the predetermined interval is attached to the punching machine, the blade tips of the punching blades are intermediately inserted in the laminated sheet in which the peelable sheets are laminated to form incisions in the depth direction thereof, and the laminated sheet is then partially removed depending on the depths of the incisions. By virtue of this method, regarding the thickness of the balance correction sheet, the thickness can be increased at a location where the punching pressure in the punching machine is weak, and the thickness can be decreased at a location where the punching pressure is strong; and this configuration functions to increase the pressure at the location where the punching pressure in the punching machine is weak and to decrease the pressure at the location of the strong punching pressure.

According to the present invention, the present invention is characterized in that the punching blades of the balance correction die have mutually aligned projecting heights; and the incisions forming a polygonal shape such as a triangular shape or a tetragonal shape are formed in the laminated sheet depending on the depths of the incisions formed by the punching blades of the balance correction die.

According to the present invention, the many incisions having polygonal shapes such as triangular shapes or tetragonal shapes are formed in the laminated sheet, in other words, corresponding to the depths of the incisions formed by the punching blades of the balance correction die, the many incisions are formed like a matrix. Therefore, it becomes easy to also reflect subtle pressure differences between the location of the weak punching pressure and the location of the strong punching pressure in the punching machine to the laminated sheet. The many incisions herein refer to at least three or more incisions.

The present invention may be configured so that, for example, incisions are formed to be comprised of a plurality of parallel continuous long incisions and a plurality of parallel intermittent short incisions in a direction intersecting with the long incisions in the same sheet, and, then, the location of the short incision may be separated after the part of the long incision is peeled off.

According to the present invention, the location of the short incision is separated after the part of the long incision is peeled of therefore, the operation of partially removing the laminated sheet depending on the depths of the incisions can be smoothly carried out.

The present invention is characterized in that a plurality of incisions formed by the punching blades are formed in an uppermost layer of the laminated sheet, and no incision is formed in the lowermost layer of the laminated sheet by the punching blades. According to the present invention, handling of the balance correction sheet becomes easy, and there is no risk that the blade tips of the balance correction die of the punching machine may abut the cutting plate on which the laminated sheet is placed.

The balance correction die of the punching machine of the present invention is characterized by being a balance correction die for punching machine used by being attached to the punching machine in order to prepare a balance correction sheet used upon punching of paper so as to form an outer shape of a paper vessel in order to correct the pressure balance of the punching machine in the punching machine to which a punching die and a cutting plate for receiving blade tips of the punching die are attached in a mutually facing manner, the balance correction die comprised of a substrate and a plurality of punching blades disposed on the substrate at a predetermined interval; wherein projecting heights of the punching blades are aligned, and incisions are configured to be formed in the depth direction of a laminated sheet by intermediately inserting the blade tips of the punching blades into the laminated sheet in which peelable sheets are laminated.

In the present invention, the plurality of punching blades are disposed at the predetermined interval on the substrate, the projecting heights of the punching blades are aligned, and, when the blade tips of the punching blades are intermediately inserted in the laminated sheet in which the peelable sheets are laminated, incisions are configured to be formed in the depth direction thereof. By virtue of this configuration, regarding the thickness of the balance correction sheet, the thickness is increased at the location where the punching pressure is weak in the punching machine, the thickness is decreased at the location where the punching pressure is strong, and the balance correction sheet having a configuration that increases the pressure at the location where the punching pressure is weak in the punching machine and decreases the pressure at the location where the punching pressure is strong can be provided.

The paper is comprised of, for example, a plurality of paper types or a complex material of the paper types and a resin or metal, other than paper, cardboard, and coating paper.

The present invention is characterized in that the punching blades are comprised of first belt-like blades disposed to be mutually parallel and second blades disposed at a predetermined interval in a direction transverse to the part between the first blades, and the incisions having a polygonal shape such as a triangular shape or a tetragonal shape in the laminated sheet depending on the depths of the incisions.

According to the present invention, the many incisions having the polygonal shape such as the triangular shape or the tetragonal shape are formed in the laminated sheet by the first blades and the second blades, in other words, the many incisions are formed like a matrix in the laminated sheet; therefore, this configuration makes it easy to reflect the subtle pressure differences between the location where the punching pressure is weak in the punching machine and the location where the punching pressure is strong to the laminated sheet.

In the present invention, for example, the second blades are in contact with one of the first blades, which are disposed to be parallel and adjacent to each other, but are not in contact with the other first blade adjacent thereto, and the incisions formed in the laminated sheet are comprised of continuous long incisions and the intermittent short incisions in the direction intersecting therewith in the same sheet.

According to the present invention, when an operation of partially removing the laminated sheet depending in the depths of the incisions is to be carried out, after the part of the continuous long incisions formed by the first blades are peeled off, the location of the intermittent short incision formed by the second blade can be separated, and the peel-off operation can be smoothly carried out.

In the present invention, the plurality of incisions are formed by the punching blades in the uppermost layer of the laminated sheet; however, it is preferred that no incision be formed by the punching blades in the lowermost layer of the laminated sheet. According to the present invention, handling of the balance correction sheet becomes easy, and there is no risk that the blade tips of the balance correction die of the punching machine may abut the cutting plate on which the laminated sheet is placed.

Effects of the Invention

According to the method for producing balance correction sheet and the balance correction die for punching machine, the predetermined balance correction die which have the plurality of punching blades disposed to be mutually parallel on the substrate and have the punching blades with the aligned projecting heights is attached to the punching machine, the blade tips of the punching blades are intermediately inserted in the laminated sheet in which the peelable sheets are laminated to form the incisions in the depth direction thereof, and the laminated sheet is then partially removed depending on the depths of the incisions; as a result, regarding the thickness of the balance correction sheet, the thickness can be increased at the location where the punching pressure is weak in the punching machine, and the thickness can be decreased at the location where the punching pressure is strong. The balance correction sheet prepared in this manner functions to increase the pressure at the location where the punching pressure is weak in the punching machine and to decrease the pressure at the location where the punching pressure is strong.

According to the present invention, the many incisions are formed like a matrix in the laminated sheet; therefore, it becomes easy to also reflect subtle pressure differences between the location where the punching pressure is weak in the punching machine and the location where the punching pressure is strong to the laminated sheet. According to the present invention, after the part of the continuous long incision is peeled off, the location of the intermittent short incision is separated; therefore, the operation of partially removing the laminated sheet depending on the depths of the incisions can be smoothly carried out. The pluralities of incisions are formed by the punching blades in the uppermost layer in the laminated sheet; however, no incision is formed by the punching blades in the lowermost layer in the laminated sheet. As a result, handling of the balance correction sheet becomes easy, and there is no risk that the blade tips of the balance correction die of the punching machine may abut the cutting plate on which the laminated sheet is placed.

According to the method of balance correction for punching machine of the present invention, the balance correction sheet is disposed at the position in the back-side direction of the cutting plate of the punching machine or disposed at the position in the back-side direction of the punching die of the punching machine, thereby functioning to increase the pressure at the location where the punching pressure is weak in the punching machine and decrease the pressure at the location where the punching pressure is strong; and, by virtue of this function, the whole pressure balance in the stage before attachment of the punching die can be corrected, and the punching unevenness of the paper vessel can be decreased in advance. Moreover, when the balance correction sheet is attached to the punching machine in advance, the state in which the pressure balance of the whole punching machine is equalized is obtained, and the unevenness removing operation upon replacement of the punching die becomes easy.

DETAILED DESCRIPTION OF THE INVENTION

Hereinafter, specific modes for carrying out the present invention will be explained by using drawings.

First Embodiment

Figure 16:
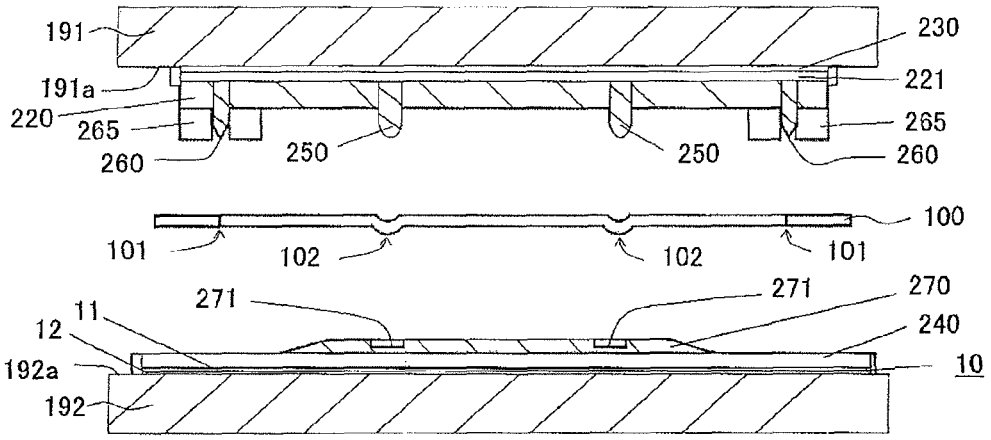
FIG. 16 is a cross-sectional view showing a state in which is sequentially from the lower side to the upper side, the surface plate, the balance correction sheet of the first embodiment, the cutting plate, and the facing plate are disposed in this order.

A balance correction die 20 of a punching machine of a first embodiment of the present invention is used by being attached to the punching machine (see FIG. 16) in order to prepare a balance correction sheet 10, which is used upon punching of paper 100 for forming the outer shape of a paper vessel, in order to correct the pressure balance of the punching machine. In other words, the balance correction die 20 of the punching machine of the present embodiment is used by being attached to the punching machine in order to prepare the balance correction sheet 10.

Figure 1:
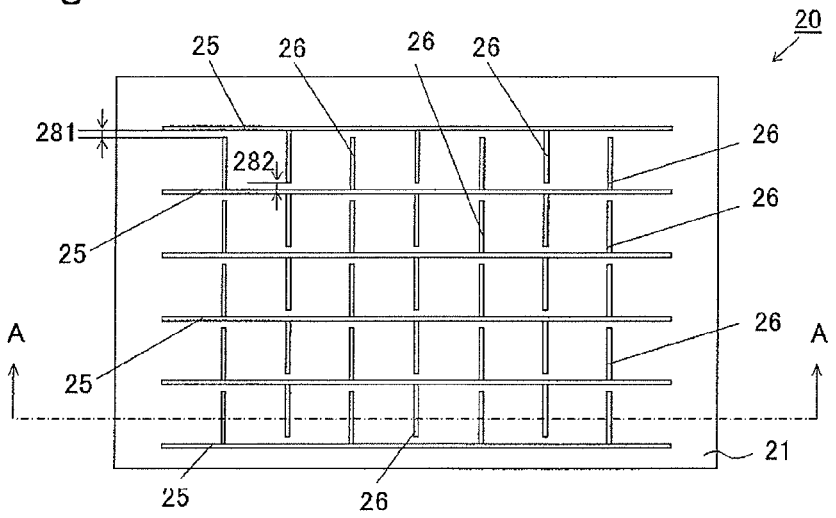
FIG. 1 is a plan view showing the balance correction die of the punching machine of the first embodiment of the present invention.

The balance correction die 20 of the punching machine is comprised of a substrate 21 and punching blades 25 and 26 (see FIG. 1). The substrate 21 has a tetragonal shape and is comprised of a thick veneer board or a resin block, and the substrate is prepared, for example, by subjecting a veneer board to laser processing along lines vertically/horizontally drawn at a predetermined interval to form penetrating grooves and embedding the punching blades 25 and 26 in the respective grooves.

On the substrate 21, the first belt-like blades 25 are disposed in parallel to one another, and the second blades 26 are disposed at a predetermined interval in a direction transverse to the first blades 25 and the parts between the first blades 25 (see FIG. 1). In the configuration example shown in FIG. 1, in a planar view, the second blades 26 are disposed to be approximately orthogonal to the first blades 25 and are disposed in a tetragonal shape like a matrix. A first end of the second blade 26 and the first blade 25 are in contact or almost in contact with each other, and a predetermined interval 281 or predetermined interval 282 is provided between a second end of the second blade 26 and the first blade 25 adjacent thereto (see FIG. 1). Therefore, the length of the second blade 26 is shorter than the interval between the first blade 25 and the first blade 25 adjacent thereto. The positions of the predetermined interval 281 and the predetermined interval 282 are approximately on a diagonal line of a tetragonal shape comprised of the punching blades 25 and 26, and the interval are arranged so that the predetermined interval and no interval are alternately formed on a single line like: the predetermined interval 281, no interval, the predetermined interval 281, no interval, and so on (see FIG. 1). This is for facilitating peel-off of sheets by causing the sheets as the sheets constituting the balance correction sheet 10, which are cut by the first blade 25 and the first blade 25 adjacent thereto, to be incised by the second blades 26 but become continuous without separation. The sheet configuration of the balance correction sheet 10 will be described later.

Figure 2:
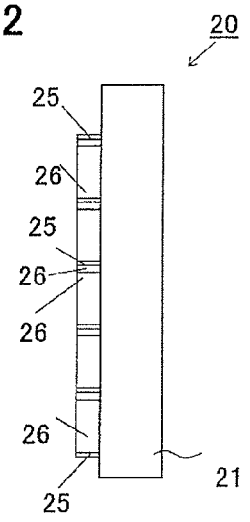
FIG. 2 is a right side view showing the balance correction die of the punching machine of the first embodiment.
Figure 3:
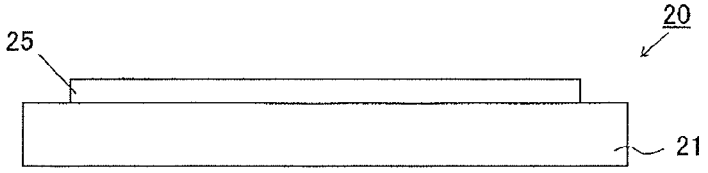
FIG. 3 is a front view showing the balance correction die of the punching machine of the first embodiment.
Figure 4:
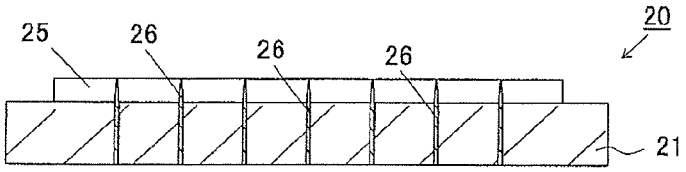
FIG. 4 is an A-A-line cross-sectional view showing the balance correction die of the punching machine of the first embodiment.

FIG. 1 is a plan view showing the balance correction die 20 of the punching machine of the present embodiment. FIG. 2 is a right side view showing the balance correction die 20 of the punching machine. FIG. 3 is a front view showing the balance correction die 20 of the punching machine. FIG. 4 is an A-A-line cross-sectional view showing the balance correction die 20 of the punching machine. According to FIG. 2 to FIG. 4, the projecting heights of the first blades 25 and the second blades 26 on the substrate 21 are aligned. Therefore, the balance correction die 20 of the punching machine is configured to form many incisions of tetragonal shapes or triangular shapes on the laminated sheet depending on the depths of the incisions.

Figure 5:
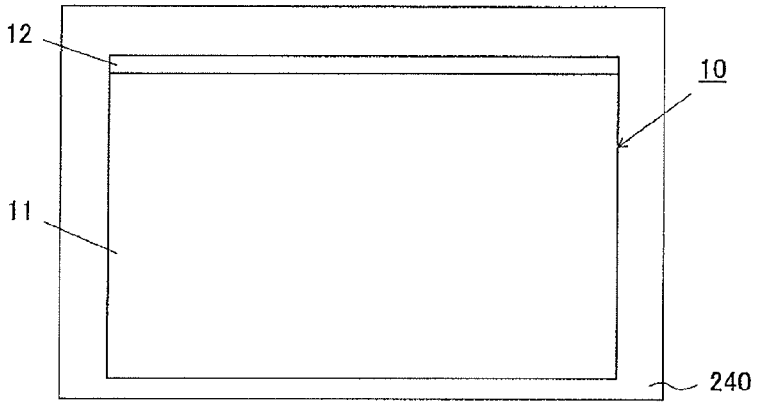
FIG. 5 is a plan view showing a state in which a laminated sheet, which serves as the balance correction sheet of the first embodiment of the present invention.
Figure 6:
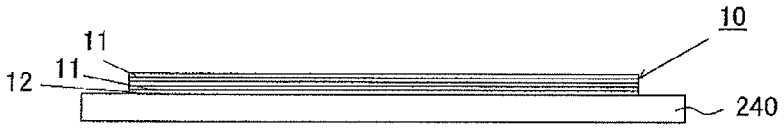
FIG. 6 is a front view showing a state in which the laminated sheet is placed on the cutting plate.

FIG. 5 is a plan view showing a state in which a laminated sheet 10, which serves as the balance correction sheet of the first embodiment of the present invention, is placed on a cutting plate 240. FIG. 6 is a front view showing a state in which the laminated sheet 10 is placed on the cutting plate 240. In the laminated sheet 10, a symbol 12 represents a lowermost-layer sheet, symbols 11 represent layers thereabove, and the plurality of peelable sheets 11 are laminated on the lowermost-layer sheet 12 (see FIG. 6). In the example shown in FIG. 5, the vertical/horizontal size of the lowermost-layer sheet 12 is set to be larger than that of the sheets 11 in the layers thereabove, and a one-side end of the lowermost-layer sheet 12 is disposed to project laterally than the sheets 11.

The materials of the sheets 11 and 12 are comprised of paper, resins, metals, complex materials thereof, etc. and are laminated so that they can be peeled off. More specifically, various thin plates of, for example, paper, polyphenylene sulfide (PPS), polypropylene (PP), polyethylene, polystyrene, polyvinyl chloride, polyethylene terephthalate (PET), polyimide, acetate, acrylic, epoxy, aluminum, iron, stainless steel, etc., and complex materials thereof can be applied to the sheets 11 and 12.

The sheet provided with the peelable function is, for example, an adhesive-agent-attached sheet in which an adhesive layer comprised of an adhesive agent is formed on at least one surface thereof. A known adhesive agent which is, for example, rubber based or acrylic is applied as the adhesive agent. For example, a sheet comprised of a material provided with an adsorbing characteristic because of, for example, the surface shape thereof or a sheet comprised of a material which carries out attraction by static electricity may be used. For example, the sheets 11 are comprised of a synthetic resin, and the sheet 12 is comprised of a metal.

For example, the thickness of the sheet 11 is set to be 10 micrometer or more and 100 micrometer or less. The thickness of the sheet 12 is set to be 20 micrometer or more and 200 micrometer or less. The number of the laminated layers of the sheets 11 is set to be 5 or more and 25 or less.

In the sheets 11, any one or more species of identifiers including colors, contrasting densities, patterns, line segments, numbers, characters, and signs is identifiably imparted to at least each of the incisions, so that the sheets are laminated to have the identifiers which are mutually different corresponding to the laminated positions thereof. In the present embodiment, the sheets 11 are color sheets; wherein, the identifying colors of the sheets 11 are different at an every certain cycle of a predetermined laminated sheet thickness, or the identifying colors of the sheets 11 are mutually different at all of the laminated positions thereof. In other words, the color sheets are colored sheets and are multicolor sheets of at least three or more colors, which are preferably corresponding to the number of the laminated layers in a one-to-one manner. According to the present embodiment, the sheets 11 are the color sheets; therefore, in which layer among the laminated sheets the incised and peeled-off sheet 11 is present becomes apparent. For example, the color sheets are colored sheets and may be laminated in the order corresponding to color codes or seven rainbow colors; wherein, as a result, in which layer among the laminated sheets it is present becomes apparent without checking a color code table.

Figure 20:
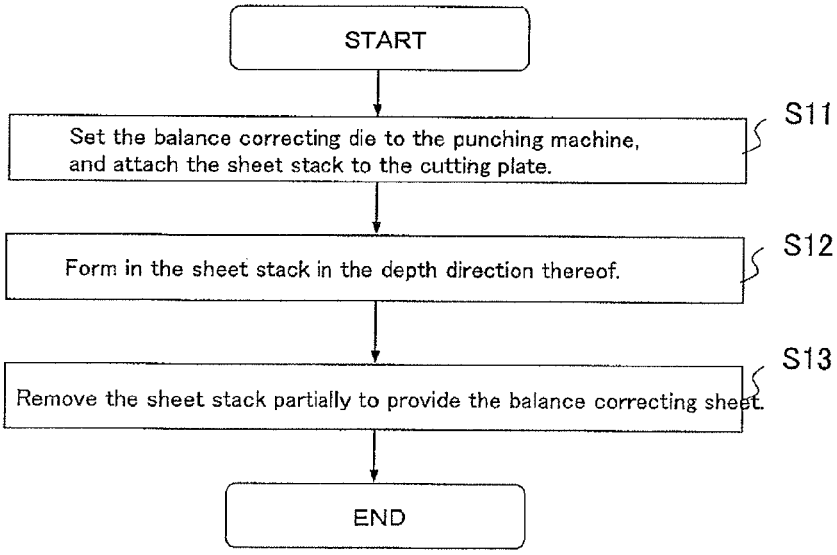
FIG. 20 is a flow chart showing a preparation procedure of the balance correction sheet according to the present invention.

FIG. 20 is a flow chart showing a preparation procedure of the balance correction sheet 10 according to the present invention. As the preparation procedure of the balance correction sheet 10, first, the balance correction die 20 is attached to the punching machine, and the laminated sheet 10 is attached to the cutting plate 240 (see Step S11). Then, the punching machine is moved, and incisions are formed in the laminated sheet 10 in the depth direction thereof (see Step S12). Then, the laminated sheet 10 is partially removed to provide the balance correction sheet 10.

Figure 7:
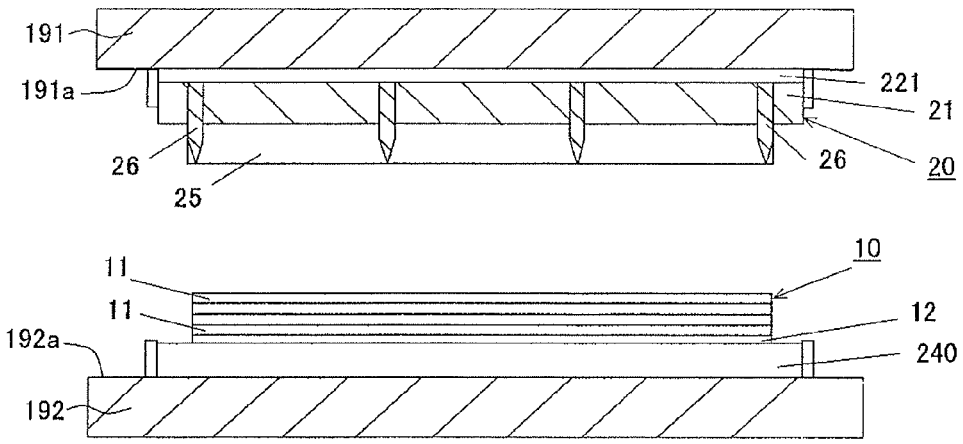
FIG. 7 is a cross-sectional view schematically showing a state in which the balance correction die, the laminated sheet, and the cutting plate of the punching machine of the first embodiment are attached to the punching machine.

FIG. 7 is a cross-sectional view schematically showing a state in which the balance correction die 20, the laminated sheet 10, and the cutting plate 240 of the punching machine of the above described embodiment are attached to the punching machine. In the example shown in FIG. 7, the balance correction die 20 of the punching machine is attached to an upper surface plate 191 side of the punching machine. The laminated sheet 10 is pasted onto the cutting plate 240. Then, the cutting plate 240 is attached to a lower surface plate 192 side of the punching machine (see FIG. 7, see Step S11), for example, by mounting the cutting plate on an unshown chase like as frame. Then, the lower surface plate 192 is moved up and then moved down to intermediately insert the blade tips of the punching blades 25 and 26 into the laminated sheet 10, thereby forming incisions in the depth direction thereof (see FIG. 7, see Step S12). FIG. 7 employs a disposition configuration in which the balance correction die 20 is in the upper side and the cutting plate 240 is in the lower side; however, a disposition configuration in which the cutting plate 240 is in the upper side and the balance correction die 20 is in the lower side is sometimes employed.

Figure 8:
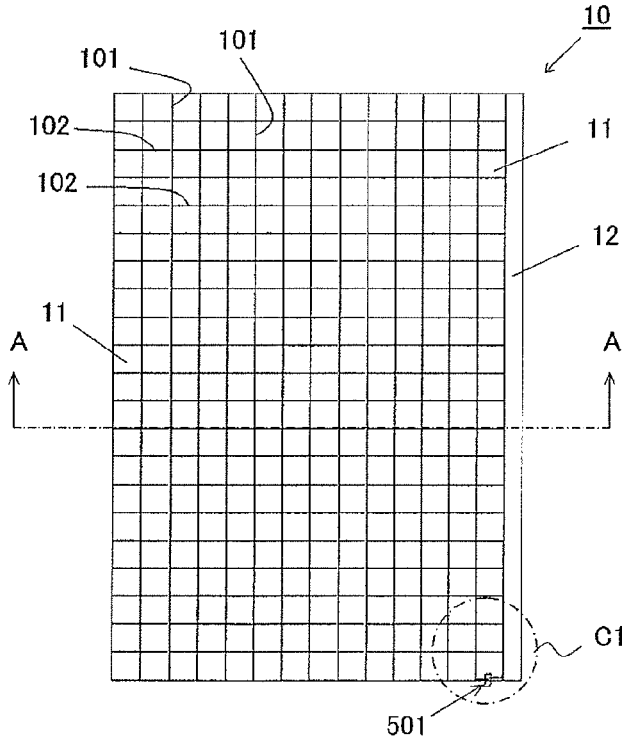
FIG. 8 is a plan view showing a state in which incisions are formed in the laminated sheet by intermediately inserting the blade tips of the balance correction die of the punching machine of the first embodiment.
Figure 9:
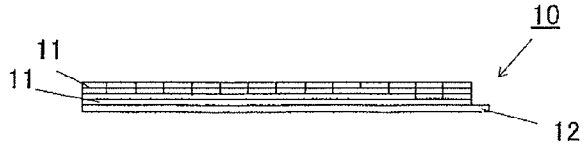
FIG. 9 is an A-A-line cross-sectional view showing a state in which the incisions are formed in the laminated sheet of the first embodiment.

FIG. 8 is a plan view showing a state in which incisions are formed in the laminated sheet 10 by intermediately inserting the blade tips of the balance correction die 20 of the punching machine of the above described embodiment. FIG. 9 is an A-A-line cross-sectional view showing a state in which the incisions are formed in the laminated sheet 10. In the laminated sheet 10, many incisions having tetragonal shapes are formed, in other words, many incisions 101 and 102 are formed like a matrix depending on the depths of the incisions formed by the punching blades of the balance correction die 20 (see FIG. 8, see FIG. 9). The incisions 101 are corresponding to the punching blades 25 of the balance correction die 20, and the incisions 102 are corresponding to the punching blades 26 of the balance correction die 20.

Figure 10:
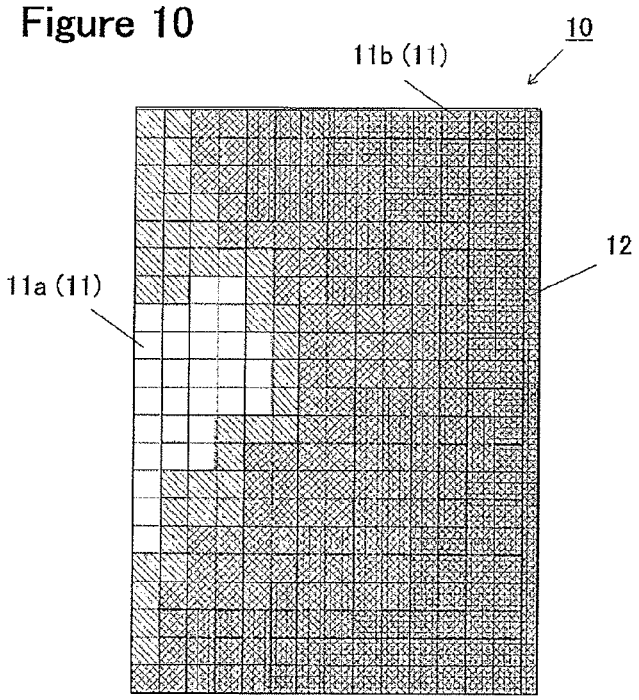
FIG. 10 is a plan view exemplifying pressure distribution of a case in which incisions are formed in the laminated sheet of the first embodiment.

FIG. 10 is a plan view exemplifying pressure distribution of a case in which incisions are formed in the laminated sheet 10. White parts 11*a* in the sheet 11 represent the parts in which the pressing force of the punching machine is large, gray parts 11*b* in the sheet 11 represent the parts in which the pressing force of the punching machine is small, and the pressing force of the punching machine is decreased as the color of the gray parts 11*b* is deepened (see FIG. 10). Therefore, since the pressing force of the punching machine is large at the white parts 11*a* in the sheet 11, the incisions formed by the punching blades of the balance correction die 20 become deep. Meanwhile, since the pressing force of the punching machine is small at the gray parts 11*b* in the sheet 11, the incisions formed by the punching blades of the balance correction die 20 become shallow.

According to the present embodiment, many incisions are formed like a matrix in the laminated sheet 10 depending on the depths of the incisions formed by the punching blades of the balance correction die 20; therefore, it becomes easy to reflect subtle pressure differences among the parts in which the punching pressure is weak and the parts in which the punching pressure is strong in the punching machine to the laminated sheet 10.

In the balance correction sheet 10, the incisions are not formed in the lowermost-layer sheet 12 of the laminated sheet. Therefore, handling of the balance correction sheet 10 is easy, and there is no risk that the blade tips of the balance correction die 20 of the punching machine may abut the cutting plate 240, on which the laminated sheet is placed.

Figure 11:
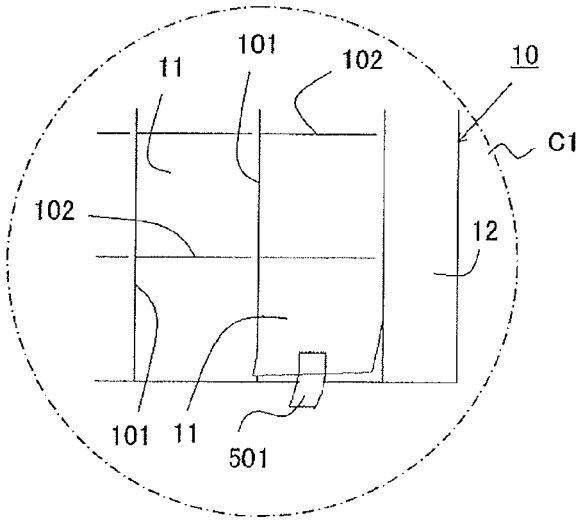
FIG. 11 is a drawing showing, in an enlarged manner, a state in which the incisions are formed in the laminated sheet of the first embodiment.

FIG. 11 is a drawing showing, in an enlarged manner, a state in which the incisions are formed in the laminated sheet 10. FIG. 11 is a drawing enlarging the area as symbol C1 surrounded by a dashed-dotted line in FIG. 8. In the present embodiment, in the laminated sheet 10, the incisions are formed so that the incisions formed in the sheet 11 are comprised of the continuous long incisions 101 and the intermittent short incisions 102 in the directions intersecting therewith in the same sheet 11 (see FIG. 11).

After the incisions are formed in the laminated sheet 10 in the depth direction thereof (see Step S12), the laminated sheet 10 is detached from the cutting plate 240, or both of the laminated sheet 10 and the cutting plate 240 are detached from the punching machine. Then, the part(s) of the laminated sheet 10 provided with the continuous long incisions 101 are peeled off and then partially removed by the location of the intermittent short incision 102 (see Step S13). For example, an operation of partially removing the laminated sheet 10 depending on the depths of the incisions is carried out by pasting an adhesive tape 501 onto a part having the continuous long incisions 101 in the same sheet 11, peeling off the part having the continuous long incisions 101 by pinching and lifting up the part with fingers, and separating the part from a location of the intermittent short incision 102 by motion such as twisting with the fingers (see FIG. 11).

Figure 12:
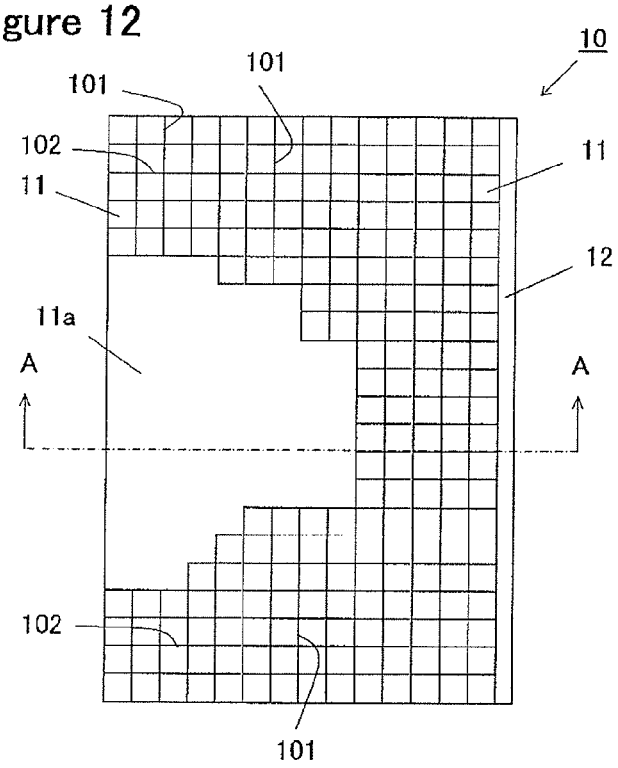
FIG. 12 is a plan view showing a state in which the laminated sheet has been partially removed view of the first embodiment.
Figure 13:
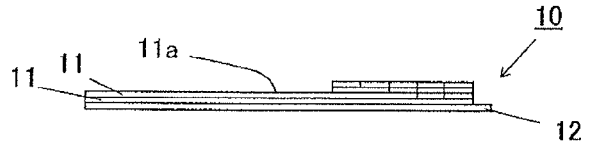
FIG. 13 is an A-A-line cross-sectional view showing a state in which the laminated sheet has been partially removed view of the first embodiment.
Figure 14:
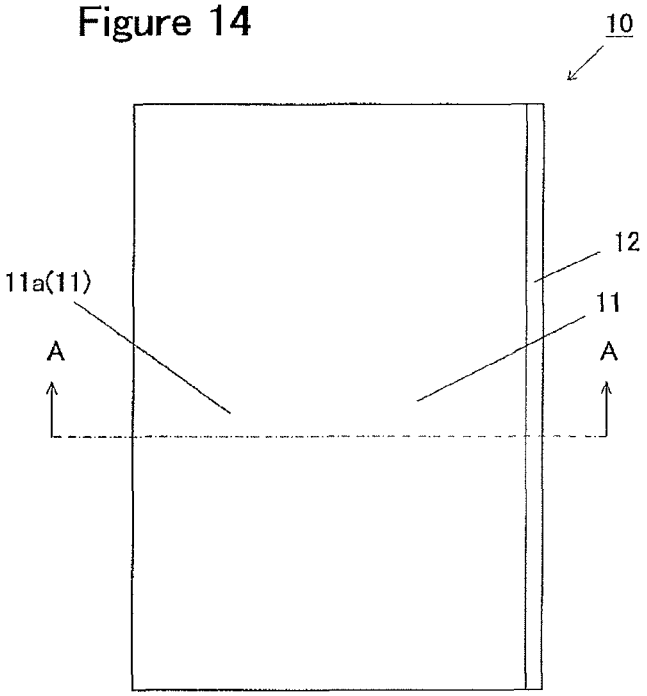
FIG. 14 is a plan view showing the balance correction sheet of the punching machine of the first embodiment of the present invention.

FIG. 12 is a plan view showing a state in which the laminated sheet 10 has been partially removed, and FIG. 13 is an A-A-line cross-sectional view thereof. When the operation of partially removing the laminated sheet 10 depending on the depths of the incisions is continued, the incisions barely appear on the surface 11*a* of the sheets 11, the state shown in FIG. 14 and FIG. 15 is obtained, and the balance correction sheet 10 of the first embodiment of the present invention is obtained.

Figure 15:
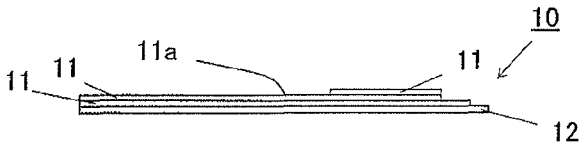
FIG. 15 is an A-A-line cross-sectional view showing the balance correction sheet of the punching machine of the first embodiment.

More specifically, in the balance correction sheet 10 of the present embodiment, the number of the laminated layers of the sheets 11 is small at the part where the pressing force of the punching machine is large, and the number of the laminated layers of the sheets 11 is large at the part where the pressing force of the punching machine is small; therefore, subtle pressure differences between the locations where the punching pressure is weak and the locations where the punching pressure is strong in the punching machine are configured to be reflected to the laminated sheet 10 (see FIG. 15). In other words, regarding the thickness of the balance correction sheet 10, the thickness is large at the locations where the punching pressure is weak in the punching machine, and the thickness is small at the locations where the punching pressure is strong. This configuration functions to increase the pressure at the locations where the punching pressure is weak in the punching machine and decrease the pressure at the locations where the punching pressure is strong.

As described above, the object of the present invention is to decrease punching unevenness of the paper vessel in advance by correcting the whole pressure balance in a stage before attachment of a punching die with respect to the punching machine in which the whole pressing-force balance has been lost due to, for example, distortion or wear of a drive part or a drive coupling part thereof, and weak-punching-pressure locations and strong-punching-pressure locations have been generated.

Figure 19:
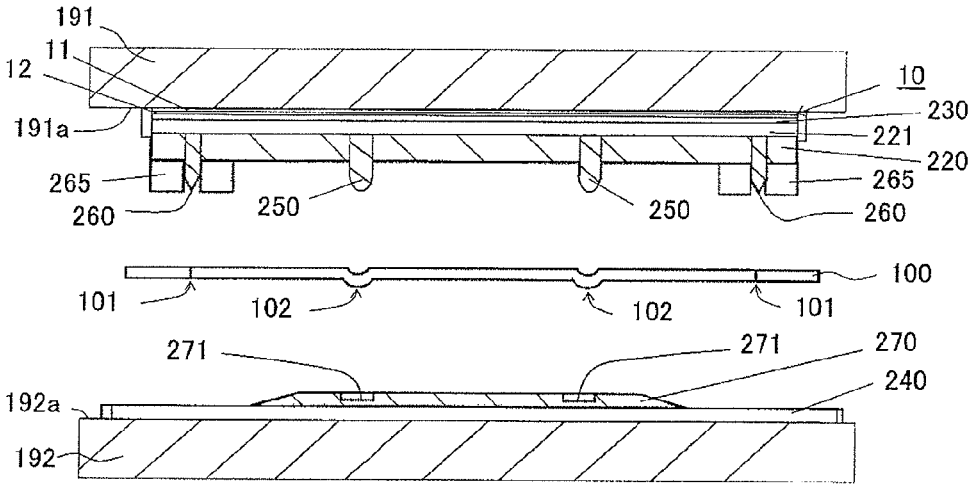
FIG. 19 is a cross-sectional view showing a state in which is sequentially from the upper side to the lower side, the surface plate, the balance correction sheet of the first embodiment, the backing metal plate, and the punching die are disposed in this order.

In the present embodiment, in order to equalize the pressure balance of the punching machine, the balance correction sheet 10 is disposed at a position in the back-side direction of the cutting plate 240 of the punching machine (see FIG. 16) or is disposed at a position in the back-side direction of the punching die 220 of the punching machine (see FIG. 19).

The balance correction sheet 10 is disposed, for example, at a position in the back-side direction of the cutting plate 240 of the punching machine. In the example shown in FIG. 16, the balance correction sheet 10 is disposed at a position between the cutting plate 240 and the surface plate 192 such the surface plate in the side facing the blade tips of the punching die 220, and the lowermost layer 12 of the sheet 10 is disposed on the surface plate surface 192*a* of the cutting plate side. In the example shown in FIG. 16, sequentially from the lower side to the upper side, the surface plate 192, the balance correction sheet 10, the cutting plate 240, and the facing plate 270 are disposed in this order.

The balance correction sheet 10 is disposed, for example, at a position in the back-side direction of the punching die 220 of the punching machine. In the example shown in FIG. 19, the balance correction sheet 10 is disposed at a position between the punching die 220 and the surface plate 191 such the surface plate in the side facing the cutting plate 240, and the lowermost layer 12 of the sheet 10 is disposed on the surface plate surface 191*a* of the punching die side. In the example shown in FIG. 19, sequentially from the upper side to the lower side, the surface plate 191, the balance correction sheet 10, the backing metal plate 221, and the punching die 220 are disposed in this order.

Figure 34:
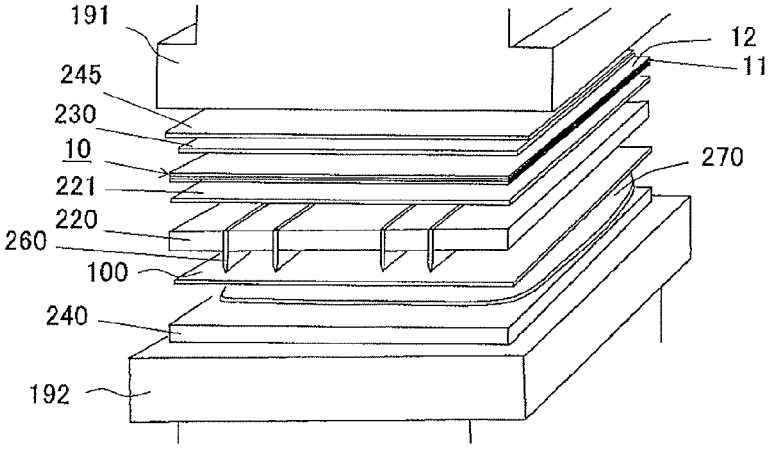
FIG. 34 is an exploded perspective view, sequentially from the upper side to the lower side, a surface plate, a protecting plate, a unevenness removing paper, the balance correction sheet of the above described embodiment, a backing metal plate, and a punching die are disposed in this order.

The balance correction sheet 10 is disposed, for example, at a position in the back-side direction of the punching die 220 of the punching machine. In the example shown in FIG. 34, the balance correction sheet 10 is disposed at a position between the punching die 220 and the surface plate 191 as the surface plate in the side facing the cutting plate 240, and the lowermost layer 12 of the sheet 10 is disposed at a position in contact with the unevenness removing paper 230. In the example shown in FIG. 34, sequentially from the upper side to the lower side, the surface plate 191, a protecting plate 245, the unevenness removing paper 230, the balance correction sheet 10, the backing metal plate 221, and the punching die 220 are disposed in this order. The protecting plate 245 is comprised of a hard metal. The unevenness removing paper 230 is not disposed in some cases.

According to the present embodiment, disposition of the balance correction sheet 10 functions to increase the pressures at the locations where the punching pressure in the punching machine is weak and decreases the pressures at the locations where the punching pressure is strong. By virtue of this function, the whole pressure balance can be corrected in a stage before attachment of the punching die, and the punching unevenness of the paper vessel is decreased in advance. More specifically, since the balance correction sheet 10 is attached to the punching machine in advance, a state in which the pressure balance of the whole punching machine is equalized is obtained; as a result, an unevenness removing operation upon replacement of the punching die 220 becomes easy.

Figure 17:
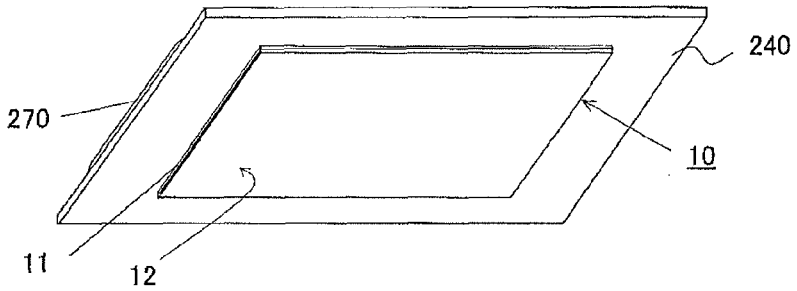
FIG. 17 is a perspective view showing, from an oblique lower side, a state in which the balance correction sheet of the first embodiment is attached to a back surface of the cutting plate.

FIG. 17 is a perspective view showing, from an oblique lower side, a state in which the balance correction sheet 10 of the present embodiment is attached to a back surface of the cutting plate 240. In FIG. 17, the balance correction sheet 10 is pasted onto the back surface of the cutting plate 240, for example, by an adhesive agent applied onto the uppermost layer 11 of the balance correction sheet 10.

Figure 18:
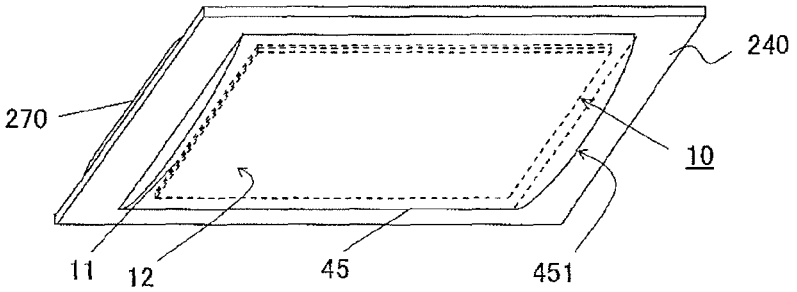
FIG. 18 is a perspective view showing, from an oblique lower side, another example of a state in which the balance correction sheet of the first embodiment is attached to the back surface of the cutting plate.

FIG. 18 is a perspective view showing, from an oblique lower side, another example of a state in which the balance correction sheet 10 of the present embodiment is attached to the back surface of the cutting plate 240. In FIG. 18, a housing pocket 45 is attached to the back-side surface of the cutting plate 240 in advance, and the balance correction sheet 10 is configured to be attachably/detachably housed from a housing opening 451 of the housing pocket 45. According to this configuration, upon replacement of the cutting plate 240, which is a consumable member, the balance correction sheet 10 can be easily taken out from the housing pocket 45 and attached to a new cutting plate 240.

Figure 26:
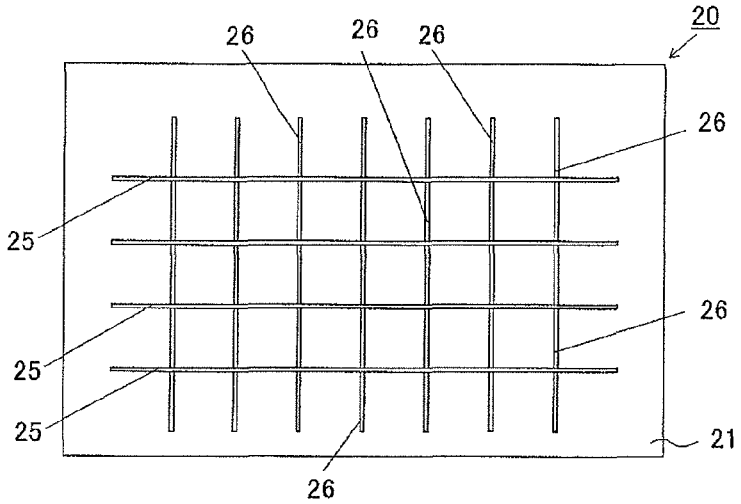
FIG. 26 is a plan view showing another example of the balance correction die of the punching machine of the above described first embodiment.
Figure 27:
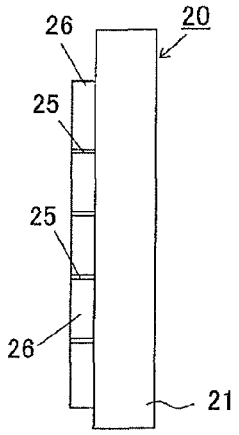
FIG. 27 is a right side view showing the balance correction die of the punching machine of the above described embodiment.

FIG. 26 is a plan view showing another example of the balance correction die 20 of the punching machine of the above described first embodiment, and FIG. 27 is a right side view showing the balance correction die 20 of the punching machine. In this configuration example, the belt-like first blades 25 are disposed in parallel to one another on the substrate 21, the second blades 26 are disposed at a predetermined interval in the direction transverse to the first blades 25 and the parts between the first blades 25, and the second blades 26 are disposed approximately orthogonal to the first blades 25 in a planar view and disposed to have a tetragonal shape like a matrix. A first end of the second blade 26 and the first blade 25 are in contact or almost in contact with each other, and a second end of the second blade 26 and the first blade 25 adjacent thereto are in contact or almost in contact with each other. Furthermore, in FIG. 26, the number of the first blades 25 in longitudinal-direction both end sides of the substrate 21 are smaller than that of FIG. 1. According to the example of FIG. 26, even when the number of the disposed punching blades 25 is decreased, lattice-like incisions similar to those of FIG. 1 can be formed.

Figure 28:
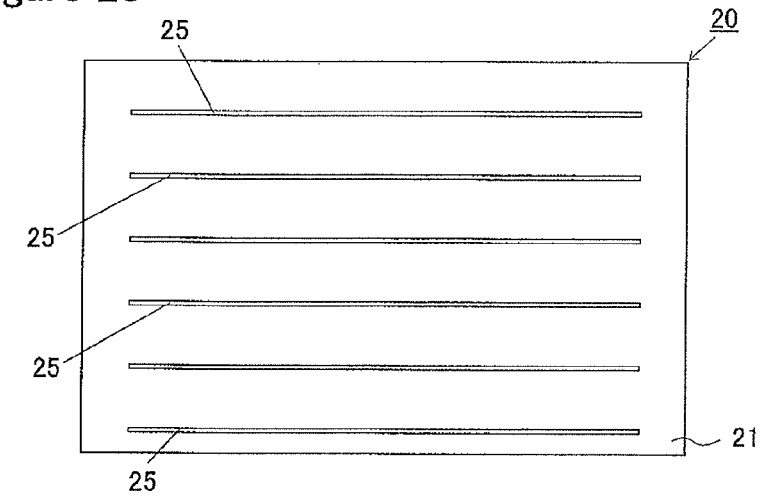
FIG. 28 is a plan view showing another example of the balance correction die of the punching machine of the above described first embodiment.
Figure 29:
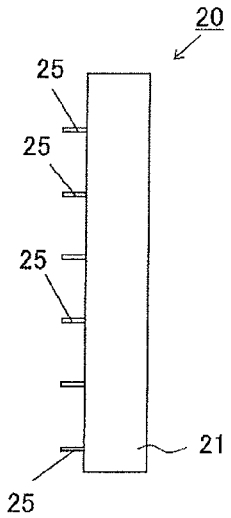
FIG. 29 is a right side view showing the balance correction die of the punching machine of the above described embodiment.
Figure 30:
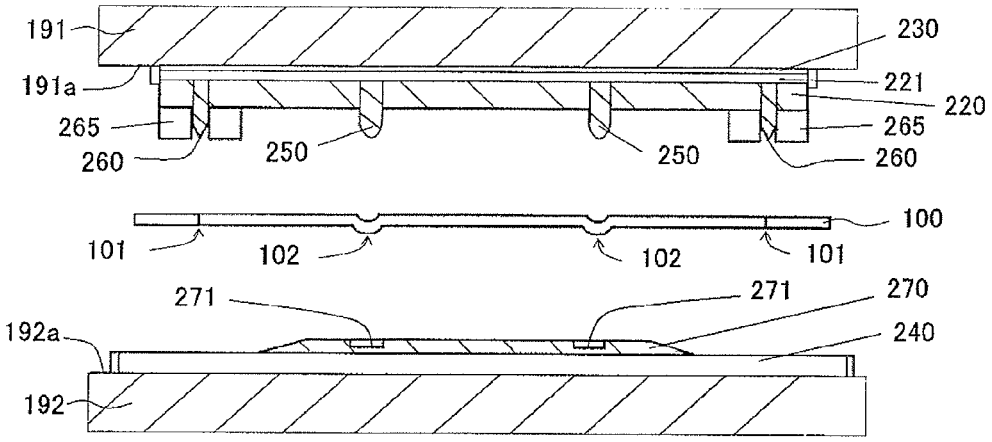
Figure 30 Prior Art
FIG. 30 is a cross-sectional view schematically showing the relations between a punching die, paper, and a cutting plate in a known punching machine.
Figure 31:
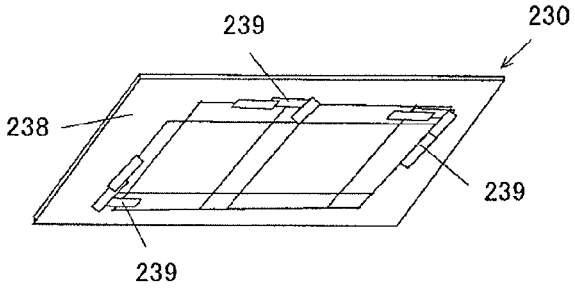
Figure 31 Prior Art
FIG. 31 is a perspective view showing known unevenness removing paper from an oblique lower side.
Figure 32:
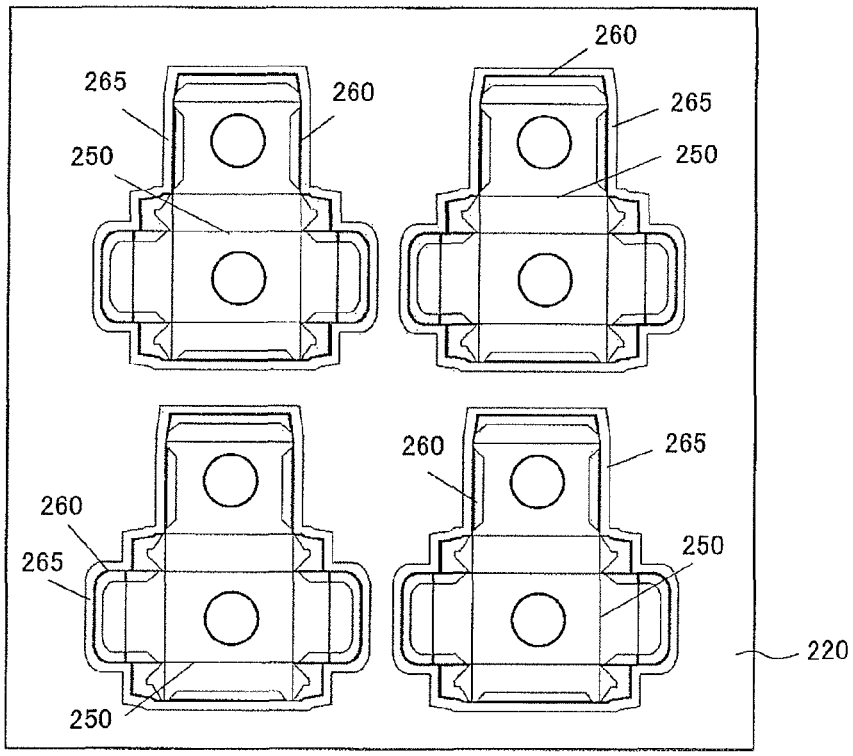
Figure 32 Prior Art
FIG. 32 is a view showing known punching die in a state in which the blade tips of punching blades are in the front side.
Figure 33:
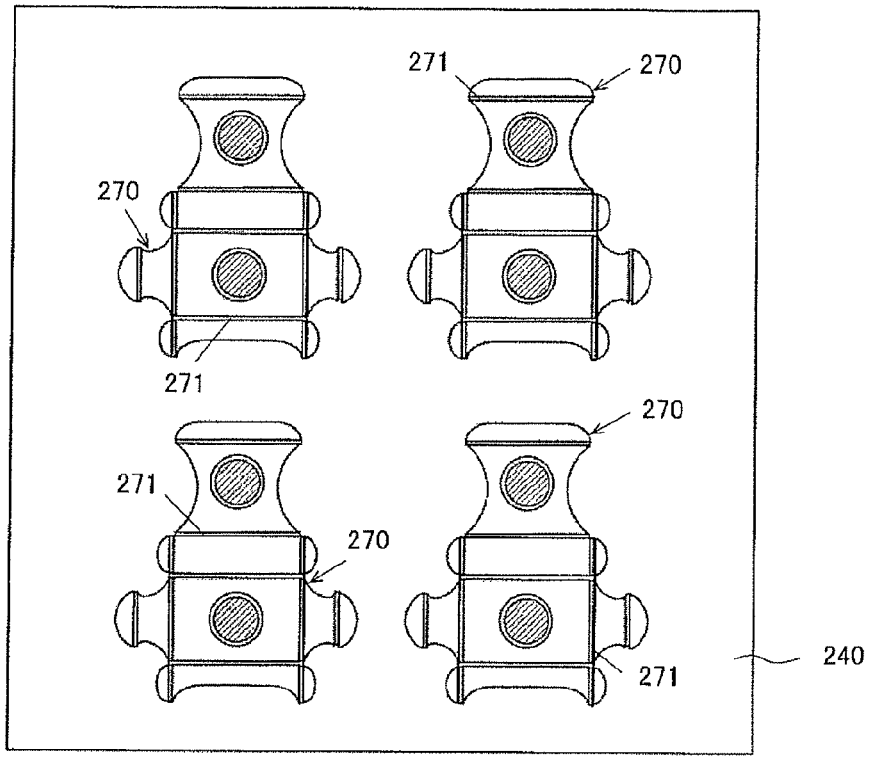
Figure 33 Prior Art
FIG. 33 is a view showing known cutting plate in a state in which facing plates are in the front side.

FIG. 28 is a plan view showing another example of the balance correction die 20 of the punching machine of the above described first embodiment, FIG. 29 is a right side view showing the balance correction die 20 of the punching machine. In this configuration example, only the belt-like first blades 25 are disposed in parallel to one another on the substrate 21. According to the example of FIG. 28, incisions can be formed without disposing the punching blades 26. In this case, although not shown in the drawing, for example, cutoff lines as perforations are configured to be formed in the laminated sheet 10 in advance at a predetermined interval in the direction orthogonal to the long incisions 101. Then, an operation of partially removing the laminated sheet 10 depending on the depths of the incisions is carried out by pasting the adhesive tape 501 onto a part having the continuous long incisions 101 in the same sheet 11, peeling off the part having the continuous long incisions 101 by pinching and lifting up the part with fingers, and separating the part from a location of the perforations by motion such as twisting with the fingers. Alternatively, an operation of partially removing the laminated sheet 10 depending on the depths of the incisions can be carried out also by separation by scissors or a knife.

Second Embodiment

A balance correction die 20 of a punching machine of a second embodiment of the present invention is comprised of a plate-like or block-like substrate 2 and punching blades 25 and 26 (see FIG. 21) as well as the above described first embodiment. Herein, the same symbols represent the same functions, and explanations thereof will be appropriately omitted.

Figure 21:
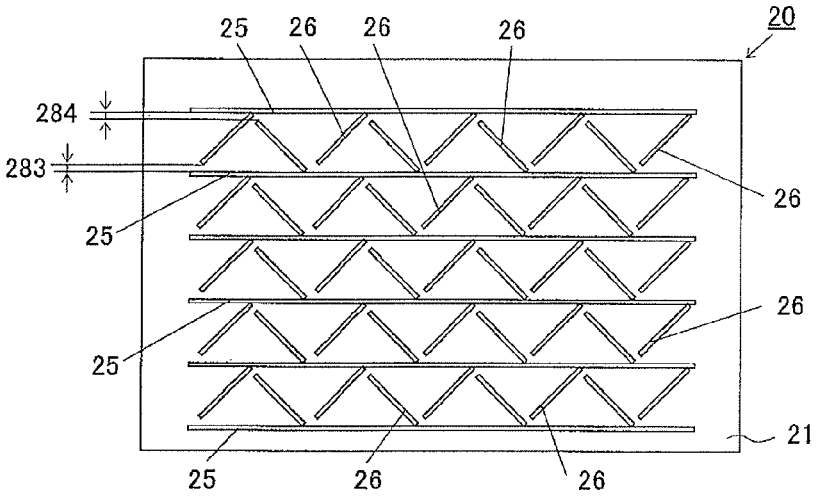
FIG. 21 is a plan view showing the balance correction die of the punching machine of the second embodiment of the present invention.

The belt-like first blades 25 are disposed in parallel to one another on the substrate 21, and the second blades 26 are disposed at a predetermined interval in the directions transverse to the first blades 25 and the parts between the first blades 25 (see FIG. 21). In the configuration example shown in FIG. 21, the second blades 26 are obliquely disposed with respect to the first blades 25 in a planar view; and, at the position between the first blade 25 and the first blade 25, the second blade 26 and the second blade 26, which are adjacent to each other, are disposed to be approximately orthogonal to each other, and the blades form triangular shapes and are disposed like a matrix. A first end of the second blade 26 and the first blade 25 are in contact or almost in contact with each other, and a predetermined interval 283 or a predetermined interval 284 is provided between a second end of the second blade 26 and the first blade 25 adjacent thereto (see FIG. 21). The positions of the predetermined interval 283 and the predetermined interval 284 are in the vicinities of the vertexes of the triangular shape comprised of the punching blades 25 and 26, and the interval are arranged so that the predetermined interval and no interval are alternately formed on a single line like: the predetermined interval 283, no interval, the predetermined interval 284, no interval, and so on (see FIG. 21). This is for facilitating peel-off of sheets by causing the sheets as the sheets constituting the balance correction sheet 10, which are cut by the first blade 25 and the first blade 25 adjacent thereto, to be incised by the second blades 26 but become continuous without separation. Although not shown in the drawing, the first blades 25 and the second blades 26 on the substrate 21 have aligned projecting heights. Therefore, the balance correction die 20 of the punching machine is configured to form many triangular incisions in the laminated sheet depending on the depths of the incisions.

Figure 22:
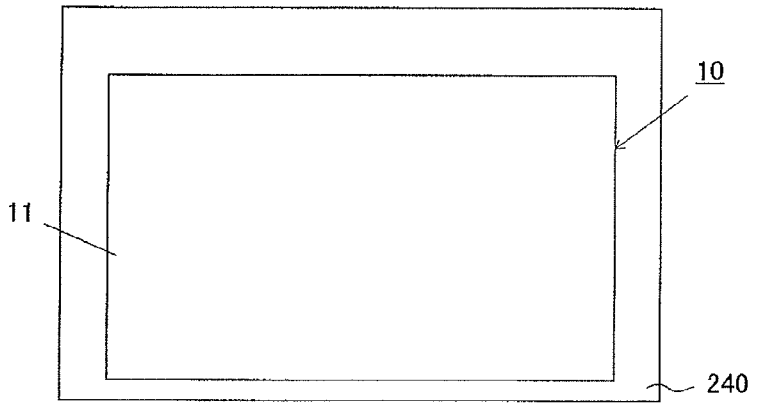
FIG. 22 is a plan view showing a state in which the laminated sheet, which serves as the balance correction sheet of the second embodiment of the present invention, is placed on the cutting plate.
Figure 23:
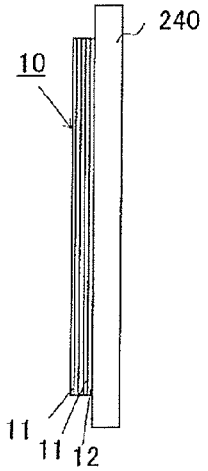
FIG. 23 is a front view showing a state in which the laminated sheet is placed on the cutting plate.

FIG. 22 is a plan view showing a state in which the laminated sheet 10, which serves as the balance correction sheet of the second embodiment of the present invention, is placed on the cutting plate 240. FIG. 23 is a front view showing a state in which the laminated sheet 10 is placed on the cutting plate 240.

In the laminated sheet 10, the symbol 12 represents a lowermost-layer sheet, the symbols 11 represent the layers thereabove, and the plurality of peelable sheets 11 are laminated on the lowermost-layer sheet 12 (see FIG. 23). In the example shown in FIG. 22, the lowermost-layer sheet 12 is set to have the same size as that of the sheets 11 in the layers thereabove.

For example, the thickness of the sheet 11 is set to 10 micrometer or more and 100 micrometer or less. The thickness of the sheet 12 is set to be 10 micrometer or more and 100 micrometer or less. The number of the laminated layers of the sheets 11 is set to be 5 or more and 25 or less.

For example, the sheets 11 are color sheets, and the identifying colors of the sheets 11 are mutually different at laminating positions. More specifically, the color sheets are colored sheets, which are multicolor sheets of at least three or more colors corresponding to the number of laminated layers in a one-to-one manner. According to the present embodiment, since the sheets 11 are color sheets, in which layer in the laminated sheet the incised and peeled-off sheet 11 is present becomes apparent.

Figure 24:
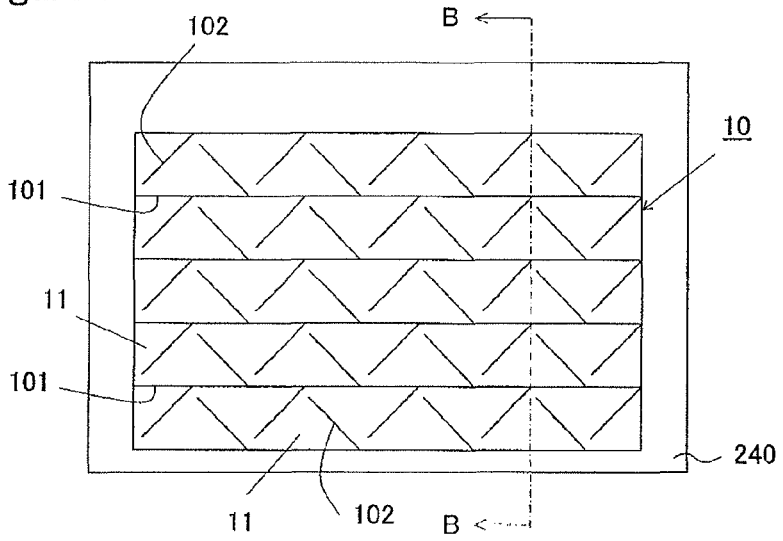
FIG. 24 is a plan view showing a state in which incisions are formed in the laminated sheet by intermediately inserting the blade tips of the balance correction die of the punching machine of the second embodiment.
Figure 25:
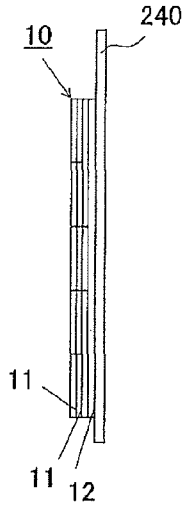
FIG. 25 is a B-B-line cross-sectional view showing a state in which the incisions are formed in the laminated sheet.

FIG. 24 is a plan view showing a state in which incisions are formed in the laminated sheet 10 by intermediately inserting the blade tips of the balance correction die 20 of the punching machine of the above described embodiment. FIG. 25 is a B-B-line cross-sectional view showing a state in which the incisions are formed in the laminated sheet 10. Many incisions having triangular shapes are formed in the laminated sheet 10, in other words, depending on the depths of the incisions formed by the punching blades of the balance correction die 20, the many incisions 101 and 102 are formed like a matrix (see FIG. 24, see FIG. 25). The incisions 101 are corresponding to the punching blades 25 of the balance correction die 20, and the incisions 102 are corresponding to the punching blades 26 of the balance correction die 20. According to the present embodiment, the incisions having the triangular shapes are the incisions more segmentalized than the incisions having the tetragonal shapes; therefore, it becomes easier to more precisely reflect the pressing-force distribution of the punching machine.

Example

The balance correction sheet 10 for correcting the pressure balance of the punching machine was prepared by using the balance correction die 20 of the punching machine of the above described first embodiment. In the laminated sheet 10, which serves as the balance correction sheet, the sheets 11 and 12 are sheets made of polyphenylene sulfide (PPS), and each sheet has a thickness of about 20 micrometer. The number of the laminated layers was 5 to 10. As the size of the laminated sheet 10, the vertical length thereof is 1050 mm, and the horizontal length thereof is 730 mm. Many lattice-like incisions having a length of 3 cm to 5 cm for one side thereof were formed by the balance correction die 20. When the balance correction sheet 20 prepared in this manner was attached to the back surface of the cutting plate 240 having a thickness of about 1 mm and made of stainless steel, the whole pressure balance in the stage before attachment of the punching die was able to be corrected with respect to the punching machine, and the punching unevenness of the paper vessel was able to be decreased in advance.

In the above described embodiments, depending on the depths of the incisions formed by the punching blades of the balance correction die 20, many incisions having tetragonal shapes or triangular shapes are formed in the laminated sheet 10; however, many incisions including combinations of hexagonal incisions or polygonal shapes may be configured to be formed in the laminated sheet 10.

In the above described embodiments, the plurality of incisions are formed by the punching blades 25 and 26 in the uppermost layer of the laminated sheet 10, and the incisions are not formed by the punching blades 25 and 26 in the lowermost layer of the laminated sheet 10. However, incisions are formed also in the lowermost layer of the laminated sheet 10 in some cases.

In the above described embodiments, the balance correction die 20 is detached, and the punching die 220 is attached. However, it is also possible to attach the punching die 220 to the balance correction die 20 in an overlapping manner or to attach the balance correction die 20 to the punching die 220 in an overlapping manner. Alternatively, the balance correction die 20 can be provided by attaching temporary punching blades 25 and 26 to the punching die 220.

In the above described embodiments, the configuration example in which the unevenness removing paper 230 is attached to the balance correction sheet 20 in an overlapping manner has been explained. However, an unevenness removing tape may be directly pasted on the balance correction sheet 20 so that it also functions as the unevenness removing paper 230. If there is no unevenness in the punching die 220 like a case in which the blade tips of the punching die 220 are aligned, the unevenness removing paper 230 is unnecessary. In this manner, it goes without saying that the present invention can be arbitrarily changed within a range not departing from the gist thereof.

The invention claimed is:

1. A method for producing balance correction sheet used for punching of paper so as to form an outer shape of a paper vessel, the balance correction sheet correcting a whole pressure balance of a punching machine, in which a punching die and a cutting plate for receiving blade tips of the punching die are attached to be opposed to each other, the method comprising the steps of:

attaching a balance correction die to the punching machine, the balance correction die having a plurality of punching blades disposed at a predetermined interval;

intermediately inserting the blade tips of the punching blades into a middle of laminated sheets formed by laminating peelable sheets, so that incisions are formed in a depth direction of the laminated sheets; and then partially removing the laminated sheets depending on depths of the incisions so as to prepare the balance correction sheet, wherein when intermediately inserting the blade tips of the punching blades into the middle of laminated sheets, the incisions are formed according to the whole pressure balance of the punching machine, and the laminated sheets are removed partially at a portion where the incisions are formed to thereby prepare the balance correction sheet according to the whole pressure balance of the punching machine, wherein a number of the laminated sheets decreases at a position where the punching pressure is strong as compared to a location where the punching pressure in the punching machine is weak.

2. The method for producing balance correction sheet according to claim 1, wherein the plurality of punching blades of the balance correction die have mutually aligned projecting heights; and the incisions forming a polygonal shape are formed in the laminated sheets depending on the depths of the incisions formed by the plurality of punching blades of the balance correction die.

3. The method for producing balance correction sheet according to claim 1, wherein the sheets have one or more species of identifiers including colors, contrasting densities, patterns, line segments, numbers, characters, and signs to identify at least each of the incisions, so that the sheets are laminated to have the identifiers which are mutually different corresponding to the laminated positions thereof.

4. The method for producing balance correction sheet according to claim 1, wherein the plurality of incisions formed by the plurality of punching blades is formed in an uppermost layer of the laminated sheet, and no incision is formed in a lowermost layer of the laminated sheets by the plurality of punching blades.

5. The method for producing balance correction sheet according to claim 1, wherein the plurality of punching plates includes first blades arranged parallel to and spaced apart from each other, and second blades arranged between the first blades to be spaced apart from each other, the second blades being attached to or located close to one of the first blades where the second blades are sandwiched so that the laminated sheets are not completely cut laterally adjacent to each other by the second blades.

6. The method for producing balance correction sheet according to claim 5, wherein the number of laminated sheets is 5 or more and 25 or less.

* * * * *